US010217429B1

(12) United States Patent
Shi et al.

(10) Patent No.: US 10,217,429 B1
(45) Date of Patent: Feb. 26, 2019

(54) GOA CIRCUIT

(71) Applicant: Shenzhen China Star Optoelectronics Semiconductor Display Technology Co., Ltd., Shenzhen (CN)

(72) Inventors: Longqiang Shi, Shenzhen (CN); Shujhih Chen, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/742,043

(22) PCT Filed: Dec. 14, 2017

(86) PCT No.: PCT/CN2017/116271
§ 371 (c)(1),
(2) Date: Jan. 5, 2018

(30) Foreign Application Priority Data

Oct. 25, 2017 (CN) ..... 2017 1 1010220

(51) Int. Cl.
*G09G 3/36* (2006.01)

(52) U.S. Cl.
CPC ... *G09G 3/3677* (2013.01); *G09G 2310/0289* (2013.01); *G09G 2310/06* (2013.01); *G09G 2330/021* (2013.01)

(58) Field of Classification Search
CPC ..... G09G 3/3677; G09G 2310/0289; G09G 2330/021; G09G 2310/06
See application file for complete search history.

(56) References Cited

U.S. PATENT DOCUMENTS

| | | | | |
|---|---|---|---|---|
| 9,501,991 | B1 * | 11/2016 | Dai | G09G 3/36 |
| 9,786,692 | B2 * | 10/2017 | Dai | H03K 19/09441 |
| 2016/0247476 | A1 * | 8/2016 | Xiao | G09G 3/3677 |
| 2016/0343336 | A1 * | 11/2016 | Dai | G11C 19/184 |
| 2017/0097650 | A1 * | 4/2017 | Zhang | G09G 3/20 |
| 2017/0213512 | A1 * | 7/2017 | Dai | G09G 3/3677 |

* cited by examiner

*Primary Examiner* — Andrew Sasinowski
(74) *Attorney, Agent, or Firm* — Leong C. Lei

(57) ABSTRACT

The invention provides a GOA circuit, the signal amplification circuit part of the N-th GOA unit of the GOA circuit comprising: first amplification circuit TFT (T1), having gate connected to DC high voltage (VGH), source and drain connected to first amplification circuit node (S(N)) and the DC high voltage (VGH); second amplification circuit TFT, having gate connected to N-th internal signal output end (G(N)_in), source and drain connected to first amplification circuit node (S(N)) and DC low voltage (VSS); third amplification circuit TFT (T3), having gate connected to DC high voltage (VGH), source and drain connected to N-th external signal output end (G(N)_out) and DC high voltage (VGH); fourth amplification circuit TFT (T4), having gate connected to first amplification circuit node (S(N)), source and drain connected to the N-th external signal output end (G(N)_out) and DC low voltage (VSS). The invention improves GOA gate output waveform and reduces power-consumption.

11 Claims, 4 Drawing Sheets

GOA CIRCUIT

BACKGROUND OF THE INVENTION

1. Field of the Invention

The present invention relates to the field of display techniques, and in particular to a gate driver on array (GOA) circuit.

2. The Related Arts

The gate driver on array (GOA) technology is suitable for the design and cost reduction of gate driver for narrow-border LCD, and is widely researched and applied.

FIG. 1 shows a schematic view of a GOA unit in a known GOA circuit. The GOA circuit in general comprises a plurality of cascaded GOA units. For a positive integer N, the N-th GOA unit is connected to an N-th signal output end G(N) and responsible for outputting an N-th horizontal scan signal. The signals required by each GOA unit are inputted from the level shift unit of the system.

FIG. 2 shows a schematic view of the waveforms of the signals required by the GOA unit, important nodes of the GOA units and voltages, wherein STV is a starting signal for inputting to the first GOA unit for activation, CK and XCK are high frequency alternating current of opposite phases, and the high/low levels of these signals are 28V and −5V respectively; these two clock signals of opposite phases are used respectively when forward/backward scanning driving is used; VSS is a low level direct current for inputting a low voltage direct current (DC), with voltage level at −5V.

On the other hand, the known IGZO-TFT has the advantages of high migration rate and good device stability.

SUMMARY OF THE INVENTION

The object of the present invention is to provide a GOA circuit, integrating the function of a level shift to the GOA circuit.

To achieve the above object, the present invention provides a GOA circuit, which comprises a plurality of cascaded GOA units, for a positive integer N, the N-th GOA unit comprising: a GOA circuit part and a signal amplification circuit part; the GOA circuit part comprising: an N-th internal signal output end, and the N-th internal signal output end being connected to the signal amplification circuit part; the signal amplification circuit part comprising:

a first amplification circuit TFT, having a gate connected to a direct current (DC) high voltage, a source and a drain connected respectively to a first amplification circuit node and the DC high voltage;

a second amplification circuit TFT, having a gate connected to the N-th internal signal output end, a source and a drain connected respectively to the first amplification circuit node and a DC low voltage;

a third amplification circuit TFT, having a gate connected to the DC high voltage, a source and a drain connected respectively to an N-th external signal output end and the DC high voltage;

a fourth amplification circuit TFT, having a gate connected to the first amplification circuit node, a source and a drain connected respectively to the N-th external signal output end and the DC low voltage.

According to a preferred embodiment of the present invention, the GOA circuit is manufactured based on IGZO-TFT.

According to a preferred embodiment of the present invention, the GOA circuit part comprises:

a first TFT, having a gate connected to an (N−1)-th internal signal output end, a source and a drain connected respectively to a first node and the (N−1)-th internal signal output end;

a second TFT, having a gate connected to the first node, a source and a drain connected respectively to a clock signal and the N-th internal signal output end;

a third TFT, having a gate connected to an (N+1)-th internal signal output end, a source and a drain connected respectively to the N-th internal signal output end and the DC low voltage;

a fourth TFT, having a gate connected to the (N+1)-th internal signal output end, a source and a drain connected respectively to the first node and the DC low voltage;

a fifth TFT, having a gate connected to a second node, a source and a drain connected respectively to the N-th internal signal output end and the DC low voltage;

a sixth TFT, having a gate connected to the second node, a source and a drain connected respectively to the first node and the DC low voltage;

a seventh TFT, having a gate connected to the clock signal, a source and a drain connected respectively to the clock signal and the second node;

an eighth TFT, having a gate connected to the first node, a source and a drain connected respectively to the second node and the DC low voltage;

a bootstrap capacitor, having two ends connected respectively to the first node and the N-th internal signal output end.

According to a preferred embodiment of the present invention, the DC low voltage is −5V.

According to a preferred embodiment of the present invention, the DC high voltage is 28V.

The present invention also provides a GOA circuit, which comprises a plurality of cascaded GOA units, for a positive integer N, the N-th GOA unit comprising: a GOA circuit part and a signal amplification circuit part; the GOA circuit part comprising: an N-th internal signal output end, and the N-th internal signal output end being connected to the signal amplification circuit part; the signal amplification circuit part comprising:

a first amplification circuit TFT, having a gate connected to a direct current (DC) high voltage, a source and a drain connected respectively to a first amplification circuit node and the DC high voltage;

a second amplification circuit TFT, having a gate connected to the N-th internal signal output end, a source and a drain connected respectively to the first amplification circuit node and a DC low voltage;

a third amplification circuit TFT, having a gate connected to the DC high voltage, a source and a drain connected respectively to a second amplification circuit node end and the DC high voltage;

a fourth amplification circuit TFT, having a gate connected to the second amplification circuit node, a source and a drain connected respectively to an N-th external signal output end and the DC high voltage;

a fifth amplification circuit TFT, having a gate connected to the first amplification circuit node, a source and a drain connected respectively to an N-th external signal output end and the DC low voltage;

an amplification circuit bootstrap capacitor, having two ends connected respectively to the second amplification circuit node and the N-th external signal output end.

According to a preferred embodiment of the present invention, the GOA circuit is manufactured based on IGZO-TFT.

According to a preferred embodiment of the present invention, the GOA circuit part comprises:

a first TFT, having a gate connected to an (N−1)-th internal signal output end, a source and a drain connected respectively to a first node and the (N−1)-th internal signal output end;

a second TFT, having a gate connected to the first node, a source and a drain connected respectively to a clock signal and the N-th internal signal output end;

a third TFT, having a gate connected to an (N+1)-th internal signal output end, a source and a drain connected respectively to the N-th internal signal output end and the DC low voltage;

a fourth TFT, having a gate connected to the (N+1)-th internal signal output end, a source and a drain connected respectively to the first node and the DC low voltage;

a fifth TFT, having a gate connected to a second node, a source and a drain connected respectively to the N-th internal signal output end and the DC low voltage;

a sixth TFT, having a gate connected to the second node, a source and a drain connected respectively to the first node and the DC low voltage;

a seventh TFT, having a gate connected to the clock signal, a source and a drain connected respectively to the clock signal and the second node;

an eighth TFT, having a gate connected to the first node, a source and a drain connected respectively to the second node and the DC low voltage;

a bootstrap capacitor, having two ends connected respectively to the first node and the N-th internal signal output end.

According to a preferred embodiment of the present invention, the DC low voltage is −5V.

According to a preferred embodiment of the present invention, the DC high voltage is 28V.

The present invention also provides a GOA circuit, which comprises a plurality of cascaded GOA units, for a positive integer N, the N-th GOA unit comprising: a GOA circuit part and a signal amplification circuit part; the GOA circuit part comprising: an N-th internal signal output end, and the N-th internal signal output end being connected to the signal amplification circuit part; the signal amplification circuit part comprising:

a first amplification circuit TFT, having a gate connected to a direct current (DC) high voltage, a source and a drain connected respectively to a first amplification circuit node and the DC high voltage;

a second amplification circuit TFT, having a gate connected to the N-th internal signal output end, a source and a drain connected respectively to the first amplification circuit node and a DC low voltage;

a third amplification circuit TFT, having a gate connected to the DC high voltage, a source and a drain connected respectively to an N-th external signal output end and the DC high voltage;

a fourth amplification circuit TFT, having a gate connected to the first amplification circuit node, a source and a drain connected respectively to the N-th external signal output end and the DC low voltage;

wherein the GOA circuit being manufactured based on IGZO-TFT;

wherein the GOA circuit part comprising:

a first TFT, having a gate connected to an (N−1)-th internal signal output end, a source and a drain connected respectively to a first node and the (N−1)-th internal signal output end;

a second TFT, having a gate connected to the first node, a source and a drain connected respectively to a clock signal and the N-th internal signal output end;

a third TFT, having a gate connected to an (N+1)-th internal signal output end, a source and a drain connected respectively to the N-th internal signal output end and the DC low voltage;

a fourth TFT, having a gate connected to the (N+1)-th internal signal output end, a source and a drain connected respectively to the first node and the DC low voltage;

a fifth TFT, having a gate connected to a second node, a source and a drain connected respectively to the N-th internal signal output end and the DC low voltage;

a sixth TFT, having a gate connected to the second node, a source and a drain connected respectively to the first node and the DC low voltage;

a seventh TFT, having a gate connected to the clock signal, a source and a drain connected respectively to the clock signal and the second node;

an eighth TFT, having a gate connected to the first node, a source and a drain connected respectively to the second node and the DC low voltage;

a bootstrap capacitor, having two ends connected respectively to the first node and the N-th internal signal output end;

wherein the DC low voltage being −5V;

wherein the DC high voltage being 28V.

In summary, the GOA circuit of the present invention can integrate the function of a level shift to the GOA circuit, is suitable for reducing the cost of driving IC as well as improving the output waveform of the gates of the GOA (the rising time and the fall time of the waveform) and the power consumption.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
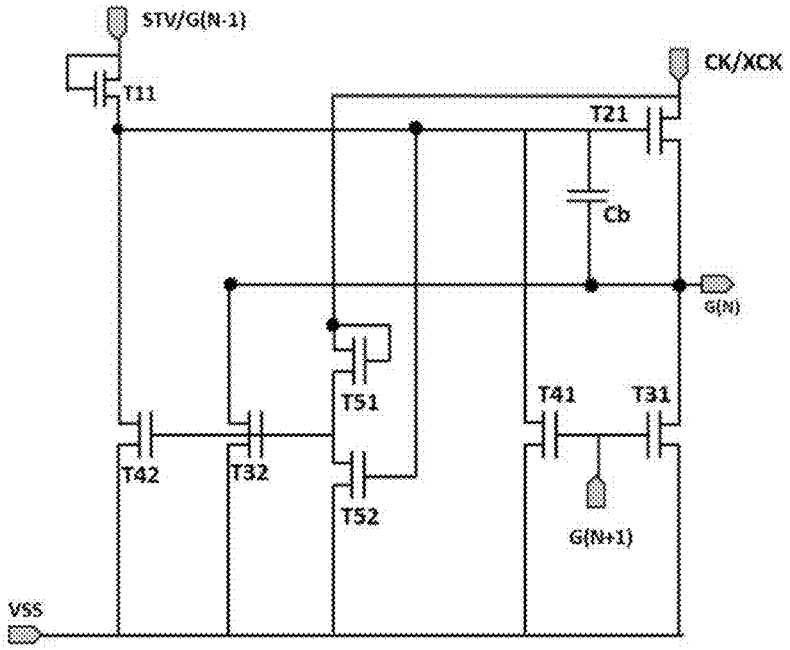
FIG. 1 is a schematic view showing a GOA unit in a known GOA circuit.
Figure 2:
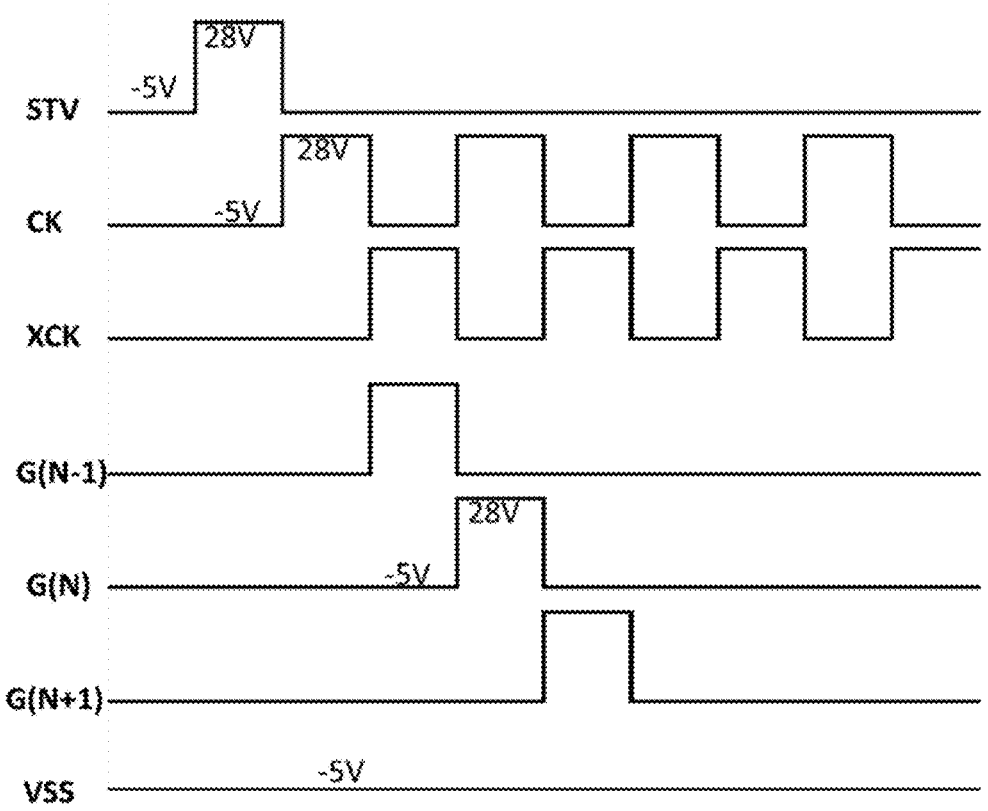
FIG. 2 is a schematic view showing the waveforms of the signals required by the GOA unit, important nodes of the GOA units and voltages.
Figure 3:
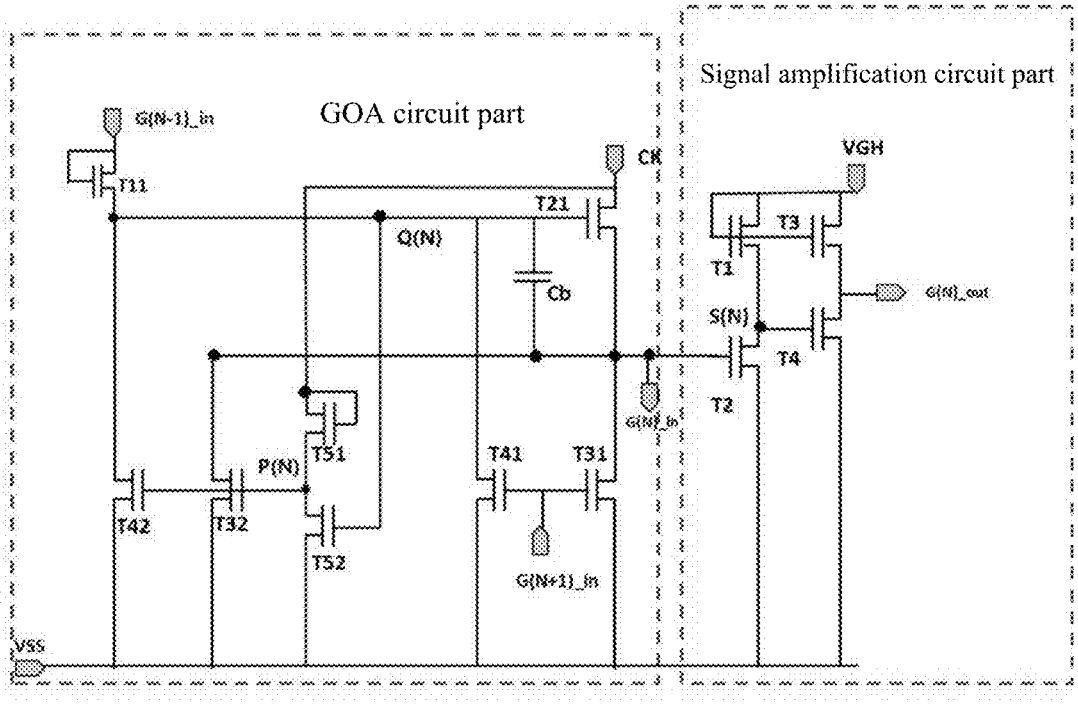
FIG. 3 is a schematic view showing a GOA unit of the GOA circuit provided by an embodiment of the present invention.

Referring to FIG. 3, the present invention provides a GOA circuit, which comprises: a plurality of cascaded GOA units, for a positive integer N, the N-th GOA unit comprising: a GOA circuit part and a signal amplification circuit part. The GOA circuit part comprises four TFTs (T1, T2, T3, T4). The GOA circuit part of the embodiment is only for explanation, other suitable forms of GOA circuit can also be used.

Figure 5:
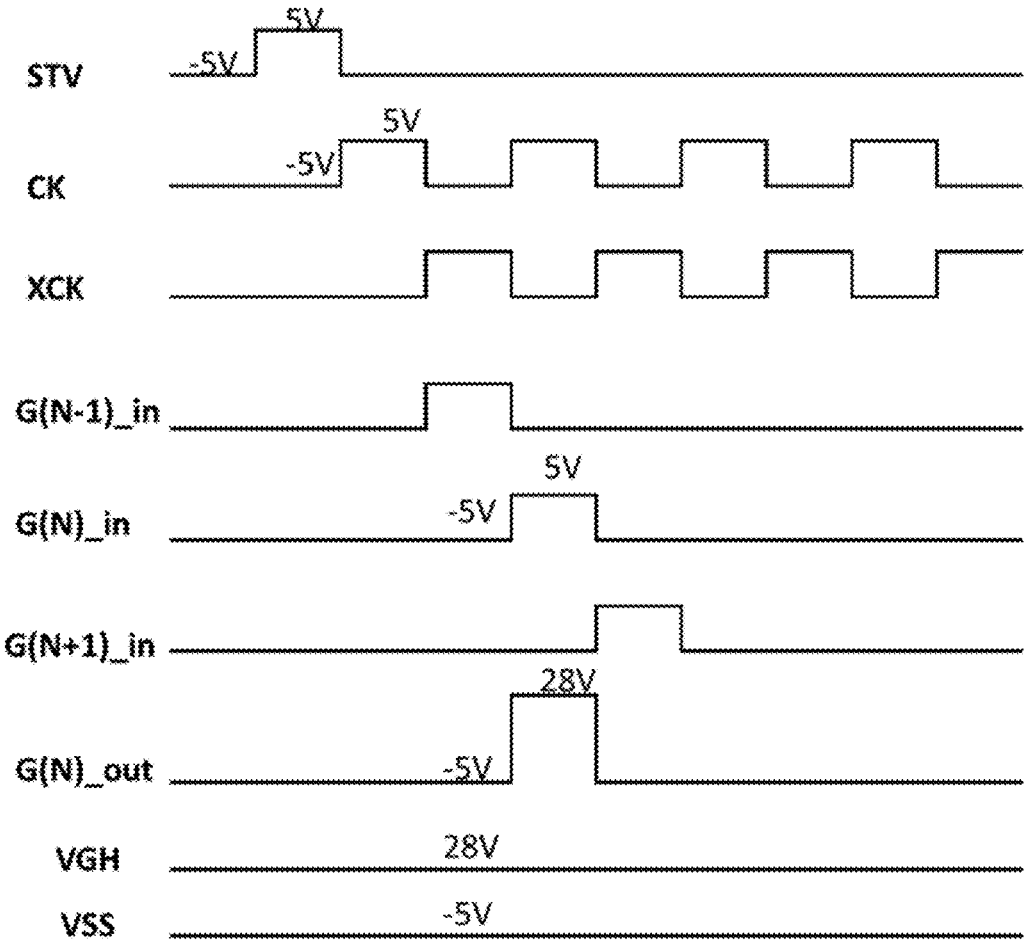
FIG. 5 is a schematic view showing the waveforms of the signals required by the GOA unit, important nodes of the GOA units and voltages for the GOA unit of FIG. 3 and FIG. 4.

FIG. 5 shows the waveforms of the signals required by the GOA unit, important nodes of the GOA units and voltages for the GOA unit of FIG. 3. STV, CK, XCK, VGH, and VSS are the signals of the system end, wherein, STV, CK, and XCk have high voltage and low voltage at 5V and −5V respectively; STV is for activating the first GOA unit; CK and XCK are two clock signals of opposite phases used respectively when the forward/backward scanning driving approach is used; VGH is the DC high voltage, and can be 28V; VSS is the DC low voltage, and can be −5V; G(N−1)_in, G(N)_in, and G(N+1)_in represent respectively the output waveform of the internal gate of the GOA circuit part of the (N−1)-th, N-th, and (N+1)-th GOA units; the waveform is a non-amplified waveform, i.e., the high/low voltage is 5V/−5V. G(N)_out is the output waveform of the output gate of the N-th GOA unit after signal amplification circuit part. The waveform is amplified. The high/low voltage of a normal driving pixel TFT gate waveform is 28V/−5V, respectively.

As shown in FIG. 3, the GOA unit comprises: a GOA circuit part and a signal amplification circuit part; the GOA circuit part comprising: an N-th internal signal output end G(N)_in, and the N-th internal signal output end G(N)_in being connected to the signal amplification circuit part; the signal amplification circuit part comprising: T1, having a gate connected to a direct current (DC) high voltage VGH, a source and a drain connected respectively to a first amplification circuit node S(N) and the DC high voltage VGH; T2, having a gate connected to the N-th internal signal output end G(N)_in, a source and a drain connected respectively to the first amplification circuit node S(N) and a DC low voltage VSS; T3, having a gate connected to the DC high voltage VGH, a source and a drain connected respectively to an N-th external signal output end G(N)_out and the DC high voltage VGH; T4, having a gate connected to the first amplification circuit node S(N), a source and a drain connected respectively to the N-th external signal output end G(N)_out and the DC low voltage VSS.

The GOA circuit part comprises: T11, having a gate connected to an (N−1)-th internal signal output end G(N−1)_in, a source and a drain connected respectively to a first node Q(N) and the (N−1)-th internal signal output end G(N−1)_in; T21, having a gate connected to the first node Q(N), a source and a drain connected respectively to a clock signal CK and the N-th internal signal output end G(N)_in; T31, having a gate connected to an (N+1)-th internal signal output end G(N+1)_in, a source and a drain connected respectively to the N-th internal signal output end G(N)_in and the DC low voltage VSS; T41, having a gate connected to the (N+1)-th internal signal output end G(N+1)_in, a source and a drain connected respectively to the first node Q(N) and the DC low voltage VSS; T42, having a gate connected to a second node P(N), a source and a drain connected respectively to the N-th internal signal output end G(N)_in and the DC low voltage VSS; T51, having a gate connected to the second node P(N), a source and a drain connected respectively to the first node Q(N) and the DC low voltage VSS; T51, having a gate connected to the clock signal CK, a source and a drain connected respectively to the clock signal CK and the second node P(N); T52, having a gate connected to the first node Q(N), a source and a drain connected respectively to the second node P(N) and the DC low voltage VSS; a bootstrap capacitor Cb, having two ends connected respectively to the first node Q(N) and the N-th internal signal output end G(N)_in.

The GOA circuit of the present invention is manufactured based on IGZO-TFT. On the basis of IGZO-TFT, the function of the level shift unit is integrated to the display so as to reduce the cost of driving IC.

The following describes the operation principle of the embodiment of FIGS. 3 and 5.

(1) when G(N)_in is at −5V (low voltage), T2 is turned off. Because T1 and T3 have the gates connected to VGH (28V), T1 and T3 are turned on. S(N) is at 28V. T4 is also turned on. Because T3 and T4 divide the voltage, G(N)_out outputs VSS (−5V).

(2) when G(N)_in is at 5V (high voltage), T2 is turned on. Because T1 has the gate connected to VGH(28V), T1 is turned on. Because T1 and T2 divide the voltage, S(N) is at −5V and T4 is turned off. G(N)_out outputs VGH (28V).

Figure 4:
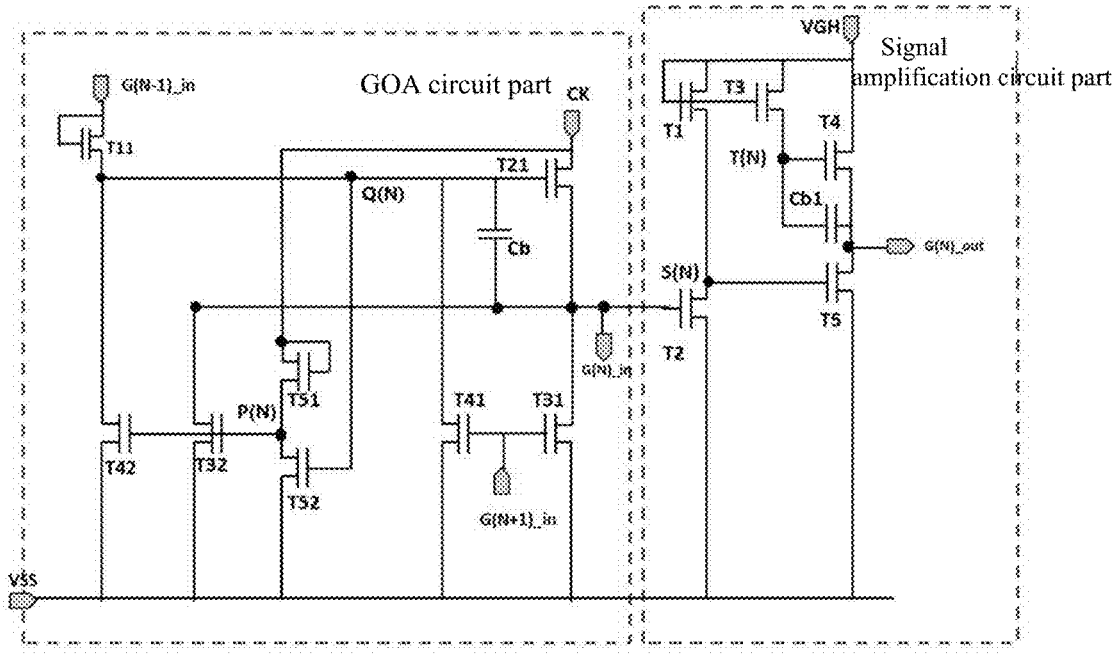
FIG. 4 is a schematic view showing a GOA unit of the GOA circuit provided by another embodiment of the present invention.

Refer to FIG. 4. FIG. 4 is a schematic view showing a GOA unit of the GOA circuit provided by another embodiment of the present invention. The GOA unit comprises: a GOA circuit part and a signal amplification circuit part; the GOA circuit part comprising 5 TFTs and a bootstrap capacitor Cb1. The GOA circuit part of the embodiment is only for explanation, other suitable forms of GOA circuit can also be used. FIG. 5 shows the waveforms of the signals required by the GOA unit, important nodes of the GOA units and voltages for the GOA unit of FIG. 4.

As shown in FIG. 4, the GOA unit comprises: a GOA circuit part and a signal amplification circuit part; the GOA circuit part comprising: an N-th internal signal output end G(N)_in, and the N-th internal signal output end G(N)_in being connected to the signal amplification circuit part; the signal amplification circuit part comprising: T1, having a gate connected to a direct current (DC) high voltage VGH, a source and a drain connected respectively to a first amplification circuit node S(N) and the DC high voltage VGH; T2, having a gate connected to the N-th internal signal output end G(N)_in, a source and a drain connected respectively to the first amplification circuit node S(N) and a DC low voltage VSS; T3, having a gate connected to the DC high voltage VGH, a source and a drain connected respectively to a second amplification circuit node end T(N) and the DC high voltage VGH; T4, having a gate connected to the second amplification circuit node T(N), a source and a drain connected respectively to an N-th external signal output end G(N)_out and the DC high voltage VGH; T5, having a gate connected to the first amplification circuit node S(N), a source and a drain connected respectively to an N-th external signal output end G(N)_out and the DC low voltage VSS; an amplification circuit bootstrap capacitor Cb1, having two ends connected respectively to the second amplification circuit node T(N) and the N-th external signal output end G(N)_out.

The embodiment provides more stable voltage output. The following refers to FIG. 4 and FIG. 5 for explaining the operation principle of the embodiment.

(1) when G(N)_in is at −5V (low voltage), T2 is turned off. Because T1 and T3 have the gates connected to VGH (28V), T1 and T3 are turned on. S(N) is at 28V. T5 is also turned on. T(N) is at 28V. T4 is turned on. Because T4 and T5 divide the voltage, G(N)_out outputs VSS (−5V).

(2) when G(N)_in is at 5V (high voltage), T2 is turned on. Because T1 has the gate connected to VGH(28V), T1 is turned on. Because T1 and T2 divide the voltage, S(N) is at −5V, and T5 is turned off. T(N) is at 28V. T4 is turned on. G(N)_out outputs VGH (28V).

In the process where the G(N)_out is changed from −5V to 28V, due to the CB1 capacitor effect, the voltage at T(N) will be raised from 28V to even higher. As such, T3 is better turned on, and the high voltage of VGH is propagated to G(N)_out better and faster so that the circuit outputs better gate output waveform and the circuit is more stable.

The highly integrated gate driver design of the present invention can be applied to LCD display and OLED display.

In summary, the GOA circuit of the present invention can integrate the function of a level shift to the GOA circuit, is suitable for reducing the cost of driving IC as well as improving the output waveform of the gates of the GOA (the rising time and the fall time of the waveform) and the power consumption.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A gate driver on array (GOA) circuit, which comprises: a plurality of cascaded GOA units, for a positive integer N, the N-th GOA unit comprising: a GOA circuit part and a signal amplification circuit part; the GOA circuit part comprising: an N-th internal signal output end, and the N-th internal signal output end being connected to the signal amplification circuit part; the signal amplification circuit part comprising:

a first amplification circuit thin film transistor (TFT), having a gate connected to a direct current (DC) high voltage, a source and a drain connected respectively to a first amplification circuit node and the DC high voltage;

a second amplification circuit TFT, having a gate connected to the N-th internal signal output end, a source and a drain connected respectively to the first amplification circuit node and a DC low voltage;

a third amplification circuit TFT, having a gate connected to the DC high voltage, a source and a drain connected respectively to an N-th external signal output end and the DC high voltage;

a fourth amplification circuit TFT, having a gate connected to the first amplification circuit node, a source and a drain connected respectively to the N-th external signal output end and the DC low voltage.

2. The GOA circuit as claimed in claim 1, wherein the GOA circuit is manufactured based on IGZO-TFT.

3. The GOA circuit as claimed in claim 1, wherein the GOA circuit part comprises:

a first TFT, having a gate connected to an (N−1)-th internal signal output end, a source and a drain connected respectively to a first node and the (N−1)-th internal signal output end;

a second TFT, having a gate connected to the first node, a source and a drain connected respectively to a clock signal and the N-th internal signal output end;

a third TFT, having a gate connected to an (N+1)-th internal signal output end, a source and a drain connected respectively to the N-th internal signal output end and the DC low voltage;

a fourth TFT, having a gate connected to the (N+1)-th internal signal output end, a source and a drain connected respectively to the first node and the DC low voltage;

a fifth TFT, having a gate connected to a second node, a source and a drain connected respectively to the N-th internal signal output end and the DC low voltage;

a sixth TFT, having a gate connected to the second node, a source and a drain connected respectively to the first node and the DC low voltage;

a seventh TFT, having a gate connected to the clock signal, a source and a drain connected respectively to the clock signal and the second node;

an eighth TFT, having a gate connected to the first node, a source and a drain connected respectively to the second node and the DC low voltage;

a bootstrap capacitor, having two ends connected respectively to the first node and the N-th internal signal output end.

4. The GOA circuit as claimed in claim 1, wherein the DC low voltage is −5V.

5. The GOA circuit as claimed in claim 1, wherein the DC high voltage is 28V.

6. A gate driver on array (GOA) circuit, which comprises: a plurality of cascaded GOA units, for a positive integer N, the N-th GOA unit comprising: a GOA circuit part and a signal amplification circuit part; the GOA circuit part comprising: an N-th internal signal output end, and the N-th internal signal output end being connected to the signal amplification circuit part; the signal amplification circuit part comprising:

a first amplification circuit thin film transistor (TFT), having a gate connected to a direct current (DC) high voltage, a source and a drain connected respectively to a first amplification circuit node and the DC high voltage;

a second amplification circuit TFT, having a gate connected to the N-th internal signal output end, a source and a drain connected respectively to the first amplification circuit node and a DC low voltage;

a third amplification circuit TFT, having a gate connected to the DC high voltage, a source and a drain connected respectively to a second amplification circuit node end and the DC high voltage;

a fourth amplification circuit TFT, having a gate connected to the second amplification circuit node, a source and a drain connected respectively to an N-th external signal output end and the DC high voltage;

a fifth amplification circuit TFT, having a gate connected to the first amplification circuit node, a source and a drain connected respectively to an N-th external signal output end and the DC low voltage;

an amplification circuit bootstrap capacitor, having two ends connected respectively to the second amplification circuit node and the N-th external signal output end.

7. The GOA circuit as claimed in claim 6, wherein the GOA circuit is manufactured based on IGZO-TFT.

8. The GOA circuit as claimed in claim 6, wherein the GOA circuit part comprises:

a first TFT, having a gate connected to an (N−1)-th internal signal output end, a source and a drain connected respectively to a first node and the (N−1)-th internal signal output end;

a second TFT, having a gate connected to the first node, a source and a drain connected respectively to a clock signal and the N-th internal signal output end;

a third TFT, having a gate connected to an (N+1)-th internal signal output end, a source and a drain connected respectively to the N-th internal signal output end and the DC low voltage;

a fourth TFT, having a gate connected to the (N+1)-th internal signal output end, a source and a drain connected respectively to the first node and the DC low voltage;

a fifth TFT, having a gate connected to a second node, a source and a drain connected respectively to the N-th internal signal output end and the DC low voltage;

a sixth TFT, having a gate connected to the second node, a source and a drain connected respectively to the first node and the DC low voltage;

a seventh TFT, having a gate connected to the clock signal, a source and a drain connected respectively to the clock signal and the second node;

an eighth TFT, having a gate connected to the first node, a source and a drain connected respectively to the second node and the DC low voltage;

a bootstrap capacitor, having two ends connected respectively to the first node and the N-th internal signal output end.

9. The GOA circuit as claimed in claim 6, wherein the DC low voltage is −5V.

10. The GOA circuit as claimed in claim 6, wherein the DC high voltage is 28V.

11. A gate driver on array (GOA) circuit, which comprises: a plurality of cascaded GOA units, for a positive integer N, the N-th GOA unit comprising: a GOA circuit part and a signal amplification circuit part; the GOA circuit part comprising: an N-th internal signal output end, and the N-th internal signal output end being connected to the signal amplification circuit part; the signal amplification circuit part comprising:

a first amplification circuit thin film transistor (TFT), having a gate connected to a direct current (DC) high voltage, a source and a drain connected respectively to a first amplification circuit node and the DC high voltage;

a second amplification circuit TFT, having a gate connected to the N-th internal signal output end, a source and a drain connected respectively to the first amplification circuit node and a DC low voltage;

a third amplification circuit TFT, having a gate connected to the DC high voltage, a source and a drain connected respectively to an N-th external signal output end and the DC high voltage;

a fourth amplification circuit TFT, having a gate connected to the first amplification circuit node, a source and a drain connected respectively to the N-th external signal output end and the DC low voltage;

wherein the GOA circuit being manufactured based on IGZO-TFT;

wherein the GOA circuit part comprises:

a first TFT, having a gate connected to an (N−1)-th internal signal output end, a source and a drain connected respectively to a first node and the (N−1)-th internal signal output end;

a second TFT, having a gate connected to the first node, a source and a drain connected respectively to a clock signal and the N-th internal signal output end;

a third TFT, having a gate connected to an (N+1)-th internal signal output end, a source and a drain connected respectively to the N-th internal signal output end and the DC low voltage;

a fourth TFT, having a gate connected to the (N+1)-th internal signal output end, a source and a drain connected respectively to the first node and the DC low voltage;

a fifth TFT, having a gate connected to a second node, a source and a drain connected respectively to the N-th internal signal output end and the DC low voltage;

a sixth TFT, having a gate connected to the second node, a source and a drain connected respectively to the first node and the DC low voltage;

a seventh TFT, having a gate connected to the clock signal, a source and a drain connected respectively to the clock signal and the second node;

an eighth TFT, having a gate connected to the first node, a source and a drain connected respectively to the second node and the DC low voltage;

a bootstrap capacitor, having two ends connected respectively to the first node and the N-th internal signal output end;

wherein the DC low voltage being −5V;

wherein the DC high voltage being 28V.

* * * * *